US008970122B2

(12) United States Patent
Kuang et al.

(10) Patent No.: US 8,970,122 B2
(45) Date of Patent: Mar. 3, 2015

(54) LED DRIVER AND THE METHOD THEREOF

(75) Inventors: Naixing Kuang, Hangzhou (CN); Haigang Cao, Hangzhou (CN); Zhijun Ye, Hangzhou (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 196 days.

(21) Appl. No.: 13/550,912

(22) Filed: Jul. 17, 2012

(65) Prior Publication Data

US 2013/0020945 A1 Jan. 24, 2013

(30) Foreign Application Priority Data

Jul. 19, 2011 (CN) ..... 2011 1 0201794

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)
USPC ..... 315/219; 315/291; 315/307; 315/308

(58) Field of Classification Search
CPC ..... H05B 41/66; H02J 9/065; B23K 9/0738; H02M 3/33592; H02M 1/32
USPC ..... 315/122, 86, 177, 219, 291, 224, 294, 315/307, 308; 363/21.14, 127, 50
See application file for complete search history.

(56) References Cited

U.S. PATENT DOCUMENTS

| | | | | |
|---|---|---|---|---|
| 5,991,172 | A * | 11/1999 | Jovanovic et al. | 363/21.14 |
| 7,345,896 | B2 * | 3/2008 | Dalal | 363/21.14 |
| 2003/0223255 | A1 * | 12/2003 | Ben-Yaakov et al. | 363/89 |
| 2010/0060179 | A1 * | 3/2010 | Newman et al. | 315/219 |
| 2010/0148740 | A1 * | 6/2010 | Saitoh | 323/283 |
| 2010/0165676 | A1 * | 7/2010 | Fang et al. | 363/50 |
| 2011/0057704 | A1 * | 3/2011 | Ptacek et al. | 327/307 |
| 2011/0228570 | A1 * | 9/2011 | Li et al. | 363/21.13 |
| 2012/0049741 | A1 * | 3/2012 | Ye et al. | 315/122 |
| 2013/0020945 | A1 * | 1/2013 | Kuang et al. | 315/122 |

* cited by examiner

*Primary Examiner* — Thuy Vinh Tran
*Assistant Examiner* — Syed M Kaiser
(74) *Attorney, Agent, or Firm* — Perkins Coie LLP

(57) ABSTRACT

A LED driver comprising: a power switch; a transformer comprising a primary winding coupled to the power switch, a secondary winding and a third winding; a current sense circuit configured to sense a current flowing through the power switch and generates a current sense signal; a zero cross detecting circuit configured to detect a current flowing through the secondary winding, and generates a zero cross detecting signal; a compensation circuit configured to compensate the current sense signal based on the current flowing through the third winding; a control circuit configured to receive the compensated current sense signal and the zero cross detecting signal, and wherein the control circuit generates a control signal to control the power switch.

12 Claims, 5 Drawing Sheets

LED DRIVER AND THE METHOD THEREOF

CROSS-REFERENCE TO RELATED APPLICATION(S)

This application claims priority to and the benefit of Chinese Patent Application No. 201110201794.4, filed Jul. 19, 2011, which is incorporated herein by reference in its entirety.

TECHNICAL FIELD

The present disclosure relates generally to electronic circuits, and more particularly but not exclusively to LED drivers and the method thereof.

BACKGROUND

LEDs are applied in various solutions, for example, LCD backlight and general lighting. LED drivers are needed to supply regulated current to LED strings. Normally, a LED driver may comprise a rectifier and a transformer. The rectifier rectifies an AC signal to a DC signal. The transformer receives the DC signal and provides a converted DC signal having a voltage value decided by the turns ratio of a primary winding of the transformer to a secondary winding of the transformer.

The conventional primary side controlled LED driver may comprise a rectifier, a power switch, a transformer, a secondary circuit, a logic control circuit and a load, e.g. LED strings. In conventional primary side controlled LED drivers, a voltage provided to the LED strings is fixed, so that a current of a LED string is inversely proportional to the number of LEDs in the LED string.

The present disclosure pertains to provide a LED driver providing a constant current to a LED string despite the varying of the number of LEDs in the LED string.

SUMMARY

It is an object of the present disclosure to provide a LED driver and the method thereof.

In accomplishing the above and other objects, there has been provided, in accordance with an embodiment of the present disclosure, a LED driver comprising: a power switch; a transformer comprising a primary winding, a secondary winding and a third winding, wherein the primary winding is coupled to the power switch, and the transformer stores or transfers energy as the power switch is turned ON and OFF; a current sense circuit coupled to the power switch to sense a current flowing through the power switch, and to generate a current sense signal based thereupon; a zero cross detecting circuit coupled to the third winding to detect a current flowing through the secondary winding, and to generate a zero cross detecting signal based thereupon, and wherein the zero cross detecting signal indicates when the current flowing through the secondary winding crosses zero; a control circuit coupled to the current sense circuit and the zero cross detecting circuit, and based on the current sense signal and the zero cross detecting signal, the control circuit generates a control signal to control the power switch; and a compensation circuit coupled to the third winding and the control circuit, wherein the compensation circuit compensates the current sense signal based on a current flowing through the third winding.

Furthermore, there has been provided, in accordance with an embodiment of the present disclosure, a method for driving LED strings by a LED driver. The LED driver comprises a power switch and a transformer, wherein the transformer comprises a primary winding, a secondary winding and a third winding, wherein the primary winding is coupled to the power switch, and the transformer stores or transfers energy as the power switch is turned ON and OFF. The method comprises: detecting a current flowing through the secondary winding and generating a zero cross detecting signal based thereupon, wherein the zero cross detecting signal indicates when the current flowing through the secondary winding crosses zero; sensing a current flowing through the power switch, and generating a current sense signal based thereupon; compensating the current sense signal based on the signal from the secondary winding; and turning ON and OFF the power switch based on the compensated current sense signal and the zero cross detecting signal.

The current sense signal which controls the LED driver together with other signals is compensated, so that to keep the current flowing through a load, e.g. LED strings, be constant even when the number of the LEDs in the string is varying.

The use of the same reference label in different drawings indicates same or like components.

DETAILED DESCRIPTION

In the present disclosure, numerous specific details are provided, such as examples of circuits, components, and methods, to provide a thorough understanding of embodiments of the disclosure. Persons of ordinary skill in the art will recognize, however, that the disclosure can be practiced without one or more of the specific details. In other instances, well-known details are not shown or described to avoid obscuring aspects of the disclosure.

Some embodiments are described in the present disclosure. In one embodiment, a compensation circuit compensates a current sense signal generated by a current sense circuit, wherein the compensation circuit is coupled between a third winding of a transformer and the current sense circuit. A control circuit controls the ON and OFF of a power switch based on a compensated current sense signal and a zero cross detecting signal. In one embodiment, the control circuit controls the ON and OFF of the power switch based on the compensated current sense signal, the zero cross detecting signal and a rectified signal. In the embodiments of the present disclosure, because the current sense signal is compensated, a current flowing through a LED string keeps constant even when number of the LEDs in a LED string varies.

In one embodiment, the compensation circuit comprises a current mirror circuit, wherein the current mirror circuit is coupled between the third winding of the transformer and the current sense circuit.

In one embodiment, the compensation circuit comprises a voltage-controlled current source, wherein the voltage-controlled current source is coupled between the third winding of the transformer and the current sense circuit.

Figure 1:
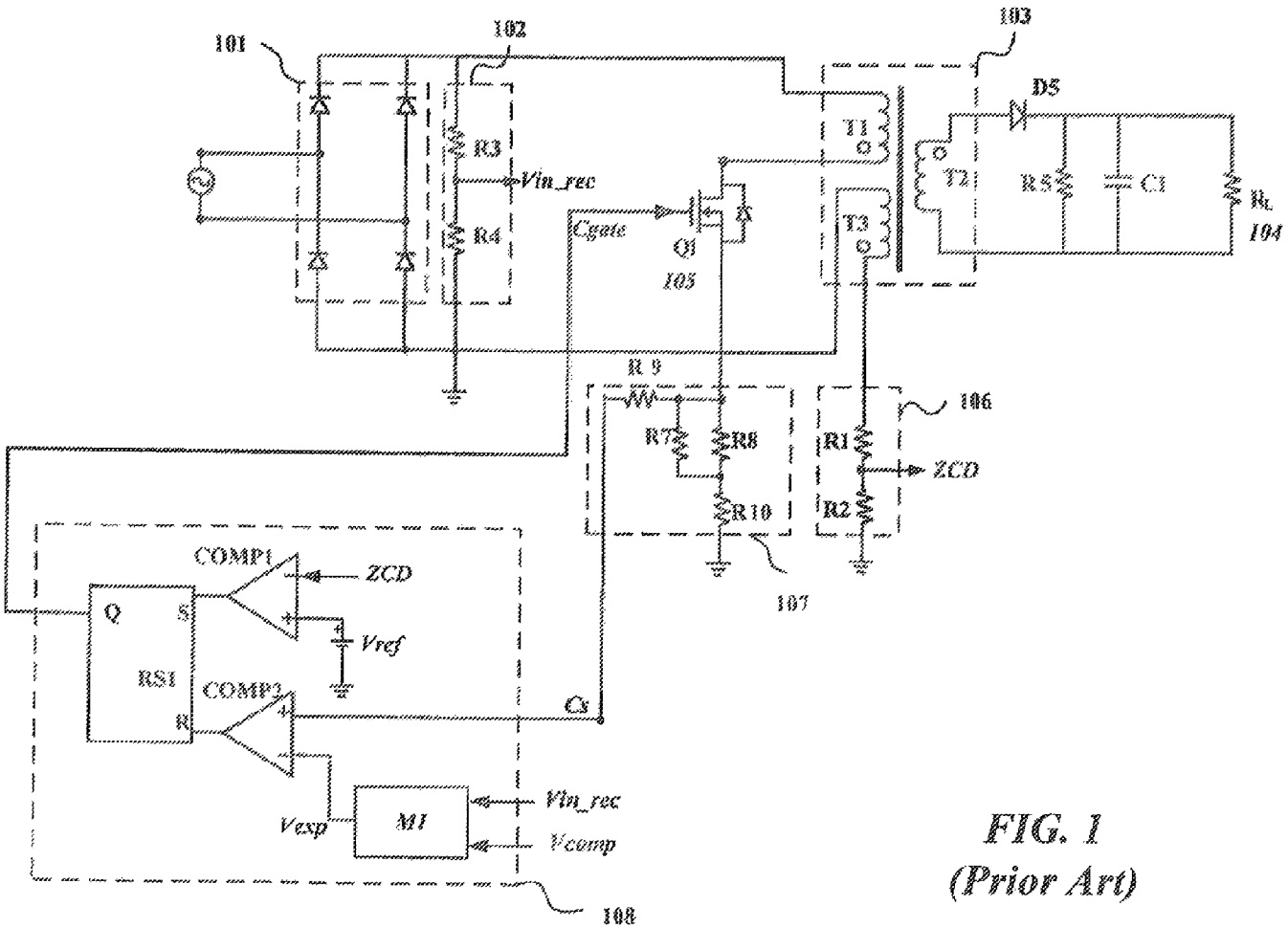
FIG. 1 (Prior Art)
FIG. 1 schematically shows a prior art primary side controlled LED driver.

FIG. 1 schematically shows a prior art LED driver. As shown in FIG. 1, the LED driver comprises: a rectifier 101, a voltage detecting circuit 102, a transformer 103, a load 104, a power switch Q1, a zero cross detecting circuit 106, a current sense circuit 107 and a control circuit 108. The transformer 103 comprises a primary winding T1, a secondary winding T2 and a third winding T3.

The rectifier 101 comprises four diodes which may be replaced by other semiconductor devices, wherein the four diodes form a full-bridge. The rectifier 101 has a first terminal and a second terminal, wherein the first terminal is coupled to a first terminal of the voltage detecting circuit 102 and a first terminal of the primary winding T1, and the second terminal is coupled to a second terminal of the voltage detecting circuit 102 and a first terminal of the third winding T3.

The voltage detecting circuit 102 comprises a resistor R3 and a resistor R4 coupled in series. The voltage detecting circuit 102 detects the output voltage of the rectifier 101 and generates a rectified signal Vin-rec based thereupon. Persons of ordinary skill in the art should know that the voltage detecting circuit 102 may comprise capacitors coupled in series or may comprise other devices.

The power switch Q1 is coupled to a second terminal of the primary winding T1, and is controlled by a control signal Cgate generated by the control circuit 108. When the power switch Q1 is ON, there is a current flowing through the primary winding T1, and thereby energy is stored in the primary winding T1. When the power switch Q1 is OFF, the energy stored in the primary winding T1 is transferred to the secondary winding T2. The secondary winding T2, a diode D5, a resistor R5, a capacitor C1 and a load $R_L$ are coupled as shown in FIG. 1. A voltage across the capacitor C1 is an output voltage supplied to the load $R_L$.

The zero cross detecting circuit 106 is coupled to a second terminal of the third winding T3. The zero cross detecting circuit 106 comprises a resistor R1 and a resistor R2 coupled in series. The zero cross detecting circuit 106 detects a current flowing through the third winding T3 which is indicative of a current flowing through the secondary winding T2. When the current flowing through the secondary winding T2 crosses zero, the zero cross detecting signal ZCD generated by the zero cross detecting circuit 106 is valid.

The current sense circuit 107 is coupled to the power switch Q1 to sense a current flowing through the power switch Q1 and to generate a current sense signal Cs based thereupon. The current sense signal Cs, the zero cross detecting signal ZCD and the rectified signal Vin-rec are provided to the control circuit 108. The control circuit 108 generates a control signal Cgate to control the ON and OFF of the power switch Q1. The current sense circuit 107 comprises a resistor network formed by a resistor R7, a resistor R8, a resistor R9 and a resistor R10.

The control circuit 108 comprises a multiplier M1. The multiplier M1 receives the rectified signal Vin-rec and an error signal VCOMP, wherein the multiplier M1 generates an expected signal Vexp by multiplying the rectified signal Vin-rec with the error signal VCOMP. A comparator COMP2 compares the expected signal Vexp with the current sense signal Cs to provide a reset signal to a reset terminal of a RS flip-flop RS1. A comparator COMP1 compares the zero cross detecting signal ZCD with a reference signal Vref, to provide a set signal to a set terminal of the RS flip-flop RS1. When the set signal at the set terminal "S" is logical high, the control signal Cgate provided at the output terminal "Q" of the RS flip-flop RS1 is logical high. When the reset signal at the reset terminal "R" is logical high, the control signal Cgate is logical low. The power switch Q1 is turned ON and OFF by the control signal Cgate, to transfer the energy stored in the primary winding T1 to the secondary winding T2.

Figure 2:
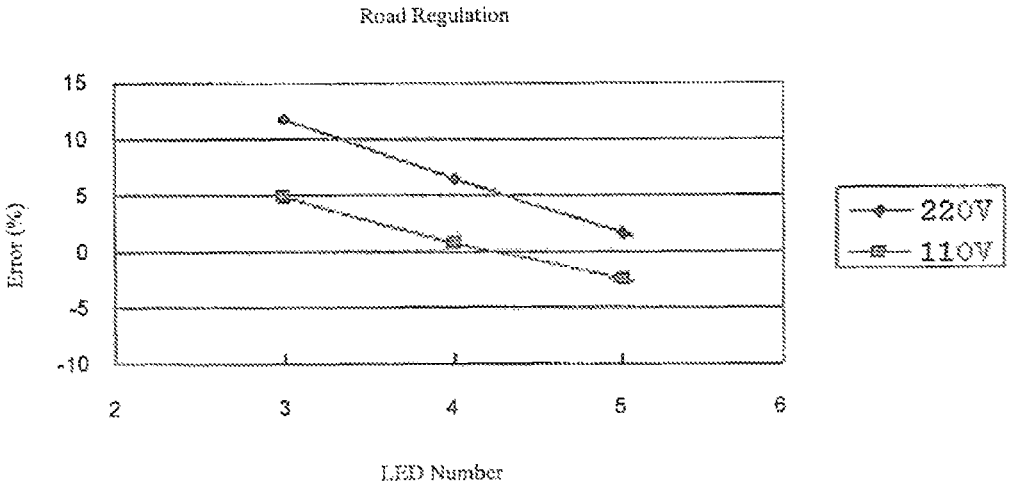
FIG. 2 (Prior Art)
FIG. 2 shows the waveform of a percentage error of a current flowing through a LED string to an average current flowing through the LED string when the number of the LEDs in the LED string is varying of the LED driver in FIG. 1.

FIG. 2 shows a curve of an error percentage of a current flowing through a LED string to an average current flowing through the LED string under different LED numbers in the string of the LED driver in FIG. 1. The X axis represents the number of the LEDs in the LED string. The Y axis represents the error percentage of the current flowing through the LED string to the average current flowing through the LED string. As shown in FIG. 2, as the number of the LEDs increases, the difference between the current flowing through the LED string and the average current flowing through the LED string decreases no matter the input voltage is 220 Volts or 110 Volts.

Figure 3:
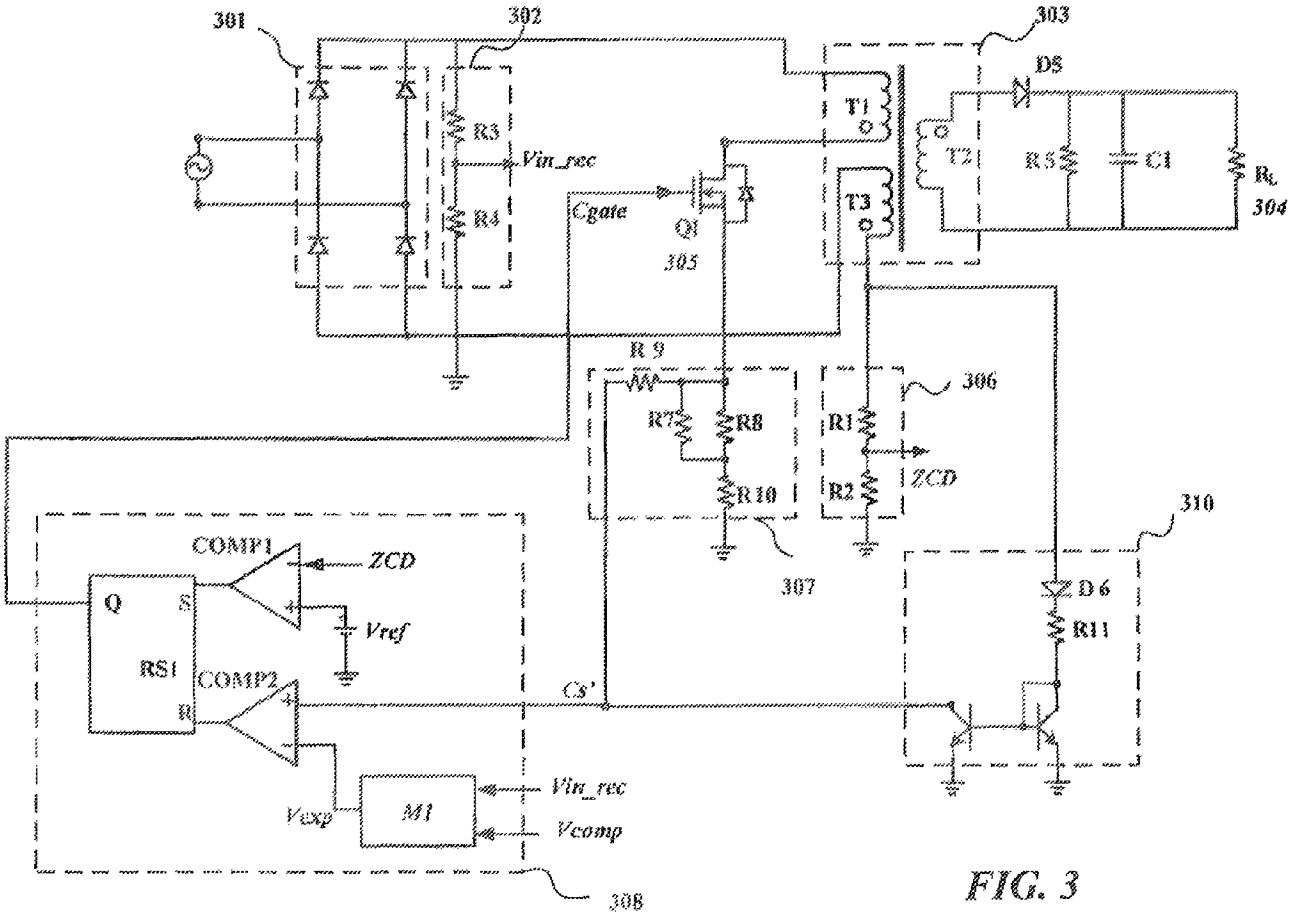
FIG. 3 schematically shows a primary side controlled LED driver in accordance with an embodiment of the present disclosure.

FIG. 3 schematically shows a LED driver in accordance with an embodiment of the present disclosure. In the example of FIG. 3, the LED driver comprises: a rectifier 301, a voltage detecting circuit 302, a transformer 303, a load 304, a power switch Q1, a zero cross detecting circuit 306, a current sense circuit 307 and a control circuit 308. The transformer 303 comprises a primary winding T1, a secondary winding T2 and a third winding T3.

The rectifier 301 comprises four diodes which may be replaced by other semiconductor devices, wherein the four diodes form a full-bridge. The rectifier 301 has a first terminal and a second terminal, wherein the first terminal is coupled to a first terminal of the voltage detecting circuit 302 and a first terminal of the primary winding T1, and the second terminal is coupled to a second terminal of the voltage detecting circuit 302 and a first terminal of the third winding T3.

The power switch Q1 is coupled to the primary winding T1, and is controlled by a control signal Cgate generated by the control circuit 308. The current sense circuit 307 is coupled to the power switch Q1 to sense a current flowing through the power switch Q1 and to generate a current sense signal Cs based thereupon. The current sense signal Cs indicates a current flowing through a LED string which is adopted as the load. In one embodiment, the current sense circuit 307 comprises resistors. Persons of ordinary skill in the art should know that any suitable current sense circuit may be adopted without detracting from the merits of the present disclosure.

In one embodiment, the LED driver further comprises a compensation circuit 310 coupled between a second terminal of the third winding T3 of the transformer 303 and an output terminal of the current sense circuit 307. The compensation circuit 310 comprises a resistor R11 and a current mirror circuit formed by several transistors. A current flowing through the resistor R11 is proportional to the voltage across the third winding T3, which is also proportional to the voltage across the secondary winding T2. The current flowing through the resistor R11 could compensate the current sense signal Cs and then eliminate the variation of the current flowing through the LED string when the number of the LEDs in the LED string varies. In other words, the current sense signal Cs may be compensated by adjusting the resistance of the resistor R11 and the resistance of the resistors of the current sense circuit 307, and thereby generating a compensated current sense signal Cs'.

In one embodiment, the current mirror circuit comprises a first NPN transistor and a second NPN transistor. An emitter current of the first NPN transistor and an emitter current of the second NPN transistor are almost the same. A collector of the first NPN transistor is coupled to the third winding T3. A collector of the second NPN transistor is coupled to an input terminal of the control circuit 308 and the output terminal of the current sense circuit 307.

In one embodiment, the emitter current of the first NPN transistor is regulated by adjusting the resistance of the resistor R11.

In one embodiment, the compensation circuit 310 further comprises a diode D6 coupled between the third winding T3 and the resistor R11.

The zero cross detecting circuit 306 comprises a resistor R1 and a resistor R2 coupled in series, wherein the zero cross detecting circuit 306 is coupled to the third winding T3. The zero cross detecting circuit 306 detects a current flowing through the secondary winding T2 by detecting the current flowing through the third winding T3, and thereby generates the zero cross detecting signal which indicates when the current flowing through the secondary winding T2 crosses zero.

The voltage detecting circuit 302 comprises a resistor R3 and a resistor R4 coupled in series, wherein the voltage detecting circuit 302 is coupled to the rectifier 301. The voltage detecting circuit 302 detects an output voltage of the rectifier 301 and generates a rectified signal Vin-rec based thereupon. Persons of ordinary skill in the art should know that the voltage detecting circuit 302 may comprise capacitors coupled in series or other devices.

In one embodiment, the control circuit 308 receives the zero cross detecting signal ZCD, the compensated current sense signal Cs' and the rectified signal Vin-rec, and then generates a control signal Cgate to control the ON and OFF of the power switch Q1.

In one embodiment, the control circuit 308 comprises a multiplier Ml. The multiplier M1 receives the rectified signal Vin-rec and an error signal VCOMP, wherein the multiplier M1 generates an expected signal Vexp by multiplying the rectified signal Vin-rec with the error signal VCOMP. A comparator COMP2 compares the expected signal Vexp with the compensated current sense signal Cs' to provide a signal to a reset terminal of a RS flip-flop RS1. A comparator COMP1 compares the zero cross detecting signal ZCD and a reference signal Vref, to provide a signal to a set terminal of the RS flip-flop RS1. When the signal at the set terminal S is logical high, the control signal Cgate provided at the output terminal Q of the RS flip-flop RS1 is logical high. When the signal at the reset terminal R is logical high, the control signal Cgate is logical low. The power switch Q1 is turned ON and OFF by the control signal Cgate, to transfer the energy stored in the primary winding T1 to the secondary winding T2.

Figure 4:
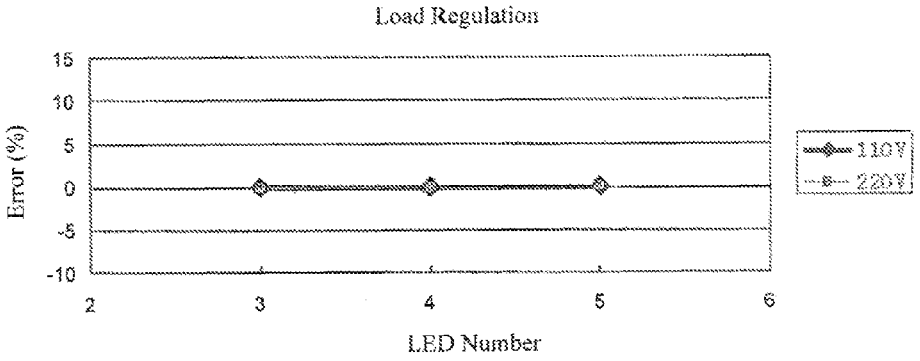
FIG. 4 shows the waveform of a percentage error of a current flowing through a LED string to an average current flowing through the LED string when the number of the LEDs in the LED string is varying of the LED driver in FIG. 3.

FIG. 4 shows the waveform of an error percentage of a current flowing through a LED string to an average current flowing through the LED string when the number of the LEDs in the LED string is varying of the LED driver in FIG. 3. As shown in FIG. 4, as the number of the LEDs increases, the difference between the current flowing through the LED string and the average current flowing through the LED string keeps constant. A current flowing through a LED string keeps constant even when the number of the LEDs in a LED string is varying no matter the rectified voltage is 220 Volts or 110 Volts.

Figure 5:
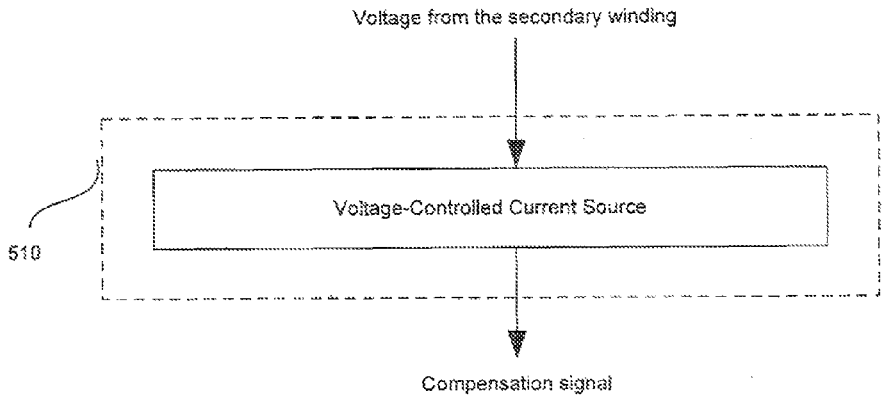
FIG. 5 shows a compensation circuit 510 in accordance with an embodiment of the present disclosure.

FIG. 5 schematically shows a compensation circuit 510 in accordance with an embodiment of the present disclosure. The compensation circuit 510 comprises a voltage-controlled current source. The voltage-controlled current source receives the signal from the third winding 73 and then generates a compensation signal to compensate the current sense signal Cs. An adjustable resistor may be coupled to an input terminal of the voltage-controlled current source to adjust the compensation signal.

Figure 6:
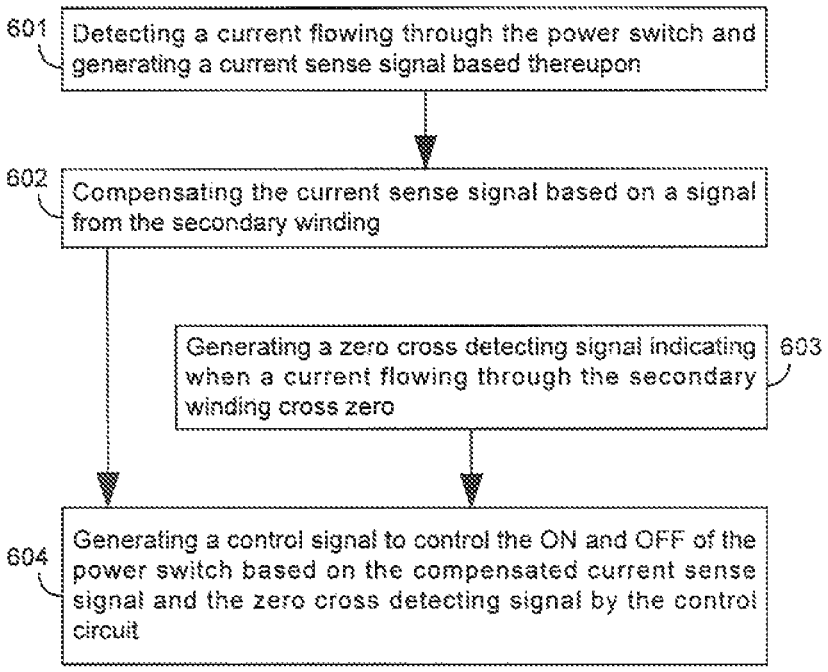
FIG. 6 shows a work flowchart of an LED driver in accordance with an embodiment of the present disclosure.

FIG. 6 shows a work flowchart of the control circuit 308 in accordance with an embodiment of the present disclosure. In the example of FIG. 6, the LED driver comprises a power switch Q1, a control circuit and a transformer. The transformer comprises a primary winding T1 coupled to the power switch Q1, a secondary winding T2 and a third winding T3. The control circuit controls the ON and OFF of the power switch so as to control the energy transferred from the primary winding T1 to the secondary winding T2.

The flowchart of the control circuit 308 comprises steps 601-604, wherein:

step 601, detecting a current flowing through the power switch, and generating a current sense signal based thereupon;

step 602, compensating the current sense signal based on a current from the third winding;

step 603, generating a zero cross detecting signal indicating when a current flowing through the secondary winding T2 crosses zero;

step 604, generating a control signal to control the ON and OFF of the power switch at least based on the compensated current sense signal and the zero cross detecting signal by the control circuit.

In one embodiment, compensating the current sense signal by a current mirror circuit based on a current flowing through the third winding T3.

In one embodiment, compensating the current sense signal by a voltage-controlled current source based on a current flowing through the third winding T3.

An effective technique for sample and hold circuit has been disclosed. While specific embodiments of the present disclosure have been provided, it is to be understood that these embodiments are for illustration purposes and not limiting. Many additional embodiments will be apparent to persons of ordinary skill in the art reading this disclosure.

We claim:

1. A LED driver for driving LED strings, comprising:

a power switch having a first terminal, a second terminal and a control terminal;

a transformer comprising a primary winding, a secondary winding and a third winding, wherein each winding has a first terminal and a second terminal, and the first terminal of the primary winding is configured to receive an input signal and the second terminal of the primary winding is coupled to the first terminal of the power switch, the secondary winding is configured to supply power to a load;

a current sense circuit configured to sense a current flowing through the power switch and generates a current sense signal based thereupon;

a zero cross detecting circuit configured to detect a current flowing through the secondary winding, and generates a zero cross detecting signal based thereupon;

a compensation circuit coupled to the third winding to receive a current flowing through the third winding, wherein based on the current flowing through the third winding, the compensation circuit generates a compensation signal to compensate the current sense signal by feeding forward a voltage across the secondary winding to eliminate a variation of a current flowing through the LED strings when a number of LEDs in the LED strings varies; and a control circuit configured to receive the compensated current sense signal and the zero cross detecting signal, wherein based on the compensated current sense signal and the zero cross detecting signal, the control circuit provides a control signal to the control terminal of the power switch to control the power switch.

2. The LED driver of claim 1, further comprising a rectifier, wherein the rectifier is configured to receive an input AC signal, and to generate the input signal.

3. The LED driver of claim 1, wherein the zero cross detecting circuit has a first input terminal, a second input terminal and an output terminal, and wherein the first input terminal is coupled to the second terminal of the third winding to receive a current flowing through the third winding, the second input terminal is connected to a primary side reference ground, and based on the current flowing through the third winding, the zero cross detecting circuit provides the zero cross detecting signal indicating when the current flowing through the secondary winding crosses zero at the output terminal.

4. The LED driver of claim 1, wherein the compensation circuit comprises a current mirror circuit having a first input terminal, a second input terminal and an output terminal, and wherein the first input terminal is coupled to the second terminal of the third winding to receive the current flowing through the third winding, the second input terminal is connected to the primary side reference ground, and based on the current flowing through the third winding, the current mirror provides the compensation signal at the output terminal.

5. The LED driver of claim 4, wherein the current mirror circuit comprises a first transistor and a second transistor, wherein each transistor has a first terminal, a second terminal and a control terminal, and wherein the first terminal of the first transistor is coupled to the second terminal of the third winding, the first terminal of the second transistor is configured to provide the compensation signal, the control terminal and the first terminal of the first transistor are coupled together, the control terminals of the transistors are respectively coupled together, and the second terminals of the transistors are coupled to the primary side reference ground.

6. The LED driver of claim 5, wherein the compensation circuit further comprises a resistor coupled between the second terminal of the third winding and the first terminal of the first transistor.

7. The LED driver of claim 6, wherein the resistor is adjustable.

8. The LED driver of claim 1, wherein the compensation circuit comprises a voltage-controlled current source having an input terminal and an output terminal, and wherein the input terminal is coupled to the second terminal of the third winding to receive the current flowing through the third winding, and based on the current flowing through the third winding, the voltage-controlled current source provides the compensation signal at the output terminal.

9. The LED driver of claim 8, wherein the compensation circuit further comprises a resistor coupled between the second terminal of the third winding and the input terminal of the voltage-controlled current source.

10. The LED driver of claim 9, wherein the resistor is adjustable.

11. The LED driver of claim 1, wherein the control circuit comprises:

a first comparator having a first input terminal, a second input terminal and an output terminal, wherein the first input terminal is configured to receive the zero cross detecting signal, and the second input terminal is configured to receive a reference signal, wherein based on the zero cross detecting signal and the reference signal, the first comparator provides a set signal at the output terminal;

a multiplier having a first input terminal, a second input terminal and an output terminal, wherein the first input terminal is configured to receive a rectified signal and the second input terminal is configured to receive an error signal, and wherein based on the rectified signal and the error signal, the multiplier provides an expected signal at the output terminal;

a second comparator having a first input terminal, a second input terminal and an output terminal, wherein the first input terminal is configured receive the compensated signal, and the second input terminal is coupled to the output terminal of the multiplier to receive the expected signal, and wherein based on the compensated signal and the expected signal, the second comparator provides a reset signal at the output terminal; and a RS flip-flop having a set terminal, a reset terminal and an output terminal, wherein the set terminal is coupled to the output terminal of the first comparator to receive the set signal, and the reset terminal is coupled to the output terminal of the second comparator to receive the reset signal, and wherein based on the set signal and the reset signal, the RS flip-flop provides the control signal at the output terminal.

12. A method for driving LED strings by a LED driver, wherein the LED driver comprises a power switch and a transformer, and wherein the transformer comprises a primary winding coupled to the power switch, a secondary winding configured to supply power to a load and a third winding, and wherein the method comprises:

detecting a current flowing through the power switch, and generating a current sense signal based thereupon;

compensating the current sense signal based on a current flowing through the third winding, wherein the current sense signal is compensated by feeding forward a voltage across the secondary winding to eliminate a variation of a current flowing through the LED strings when a number of LEDs in the LED strings varies;

generating a zero cross detecting signal indicating when a current flowing through the secondary winding crosses zero; and generating a control signal to control the power switch based on the compensated current sense signal and the zero cross detecting signal by the control circuit.

* * * * *